US009671732B2

(12) United States Patent
Fukunaga

(10) Patent No.: US 9,671,732 B2
(45) Date of Patent: Jun. 6, 2017

(54) IMAGE FORMING APPARATUS PROVIDED WITH FIXING UNIT HAVING MECHANISM CAPABLE OF SELECTIVELY EXECUTING DRIVING OF ROLLER OR OPERATION OF VARYING FIXING NIP PRESSURE BY SWITCHING ROTATION DIRECTION OF ONE DRIVING INPUT GEAR

(71) Applicant: KYOCERA Document Solutions Inc., Osaka (JP)

(72) Inventor: Yasuyuki Fukunaga, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/929,896

(22) Filed: Nov. 2, 2015

(65) Prior Publication Data

US 2016/0342118 A1 Nov. 24, 2016

(30) Foreign Application Priority Data

Nov. 18, 2014 (JP) ..... 2014-233686

(51) Int. Cl.
*G03G 15/20* (2006.01)

(52) U.S. Cl.
CPC ..... *G03G 15/2064* (2013.01)

(58) Field of Classification Search
CPC ..... G03G 21/1857; G03G 21/186; G03G 15/2064
USPC ..... 399/122
See application file for complete search history.

(56) References Cited

U.S. PATENT DOCUMENTS

2015/0212466 A1* 7/2015 Fukunaga ..... G03G 15/2064 399/122

FOREIGN PATENT DOCUMENTS

JP 2001-201976 A 7/2001
JP 2009282401 A * 12/2009

* cited by examiner

*Primary Examiner* — Quana M Grainger
(74) *Attorney, Agent, or Firm* — IP Business Solutions, LLC

(57) ABSTRACT

In an image forming apparatus including a fixing unit and a storage part, the fixing unit includes: two rollers forming a fixing nip part; a pressure adjustment mechanism varying fixing nip pressure; one driving input gear receiving: a rotational power in a first direction for driving the two rollers and a rotational power in a second direction for actuating the pressure adjustment mechanism; and a gear cover supporting, with a long hole, a bearing supporting a rotary shaft of the driving input gear. The gear cover has a convex part, and the storage part has a receiving part supporting the bearing of the driving input gear at time of insertion of the fixing unit. The receiving part has a concave part fitted with the convex part of the gear cover moving with respect to the bearing of the driving input gear at the time of insertion of the fixing unit.

7 Claims, 16 Drawing Sheets

IMAGE FORMING APPARATUS PROVIDED WITH FIXING UNIT HAVING MECHANISM CAPABLE OF SELECTIVELY EXECUTING DRIVING OF ROLLER OR OPERATION OF VARYING FIXING NIP PRESSURE BY SWITCHING ROTATION DIRECTION OF ONE DRIVING INPUT GEAR

INCORPORATION BY REFERENCE

This application claims priority to Japanese Patent Application No. 2014-233686 filed on Nov. 18, 2014, the entire contents of which are incorporated by reference herein.

BACKGROUND

This disclosure relates to an image forming apparatus provided with a fixing unit, and more specifically to a technology of, in a fixing unit having a mechanism capable of selectively executing driving of a roller or operation of varying fixing nip pressure by switching a rotation direction of one driving input gear, suppressing dislocation of the fixing unit attached to a main body of the image forming apparatus from its attachment position which dislocation is likely to occur at time of the switching of the rotation direction of the driving input gear.

In recent years, in an image forming apparatus of an electrophotographic type or an electrostatic recording type, a fixing unit is typically inserted into a storage part of a main body of the image forming apparatus.

The fixing unit unitizes a large portion of a fixing-related mechanism, and sandwiches, between two rollers of a heat roller and a pressure roller paper on which a toner image has been formed in a former process, then pass the paper therebetween (hereinafter referred to as "a fixing nip part"), thereby being able to heat and pressurize the paper to fix the toner image.

In the image forming apparatus described above, if an image is formed on paper, such as an envelope or thin paper, which is relatively not durable (thin paper), a contact-pressure force (hereinafter referred as "fixing nip pressure" between the two rollers of the fixing unit is too strong, causing a wrinkle in some cases.

Suggested is a fixing device capable of preventing such occurrence of a wrinkle by including applied pressure force adjustment means capable of varying the fixing nip pressure. With this fixing device, in accordance with a kind and a thickness of a recording medium, an applied pressure force and a fixing speed can be set at optimum condition, which can therefore ensure sufficient fixing performance and prevent the occurrence of a wrinkle.

SUMMARY

As one aspect of this disclosure, a technology obtained by further improving the technology described above has been suggested.

An image forming apparatus according to one aspect of this disclosure includes a fixing unit and a storage part into which the fixing unit is inserted.

The fixing unit includes: two rollers, a pressure adjustment mechanism, one driving input gear, and a gear cover.

The two rollers forms a fixing nip part.

The pressure adjustment mechanism varies fixing nip pressure between the two rollers.

To the one driving input gear, a rotational power in a first direction driving the two rollers and a rotational power in a second direction rotating in the direction opposite to the first direction and actuating the pressure adjustment mechanism are transmitted from a driving source outside of the fixing unit.

The gear cover is formed with a hole supporting a bearing supporting a rotary shaft of the driving input gear and supports the bearing in a state in which the bearing penetrates through the hole and is projected in a direction in which the rotary shaft extends. The gear cover has a cover side engagement part extending in a direction perpendicular to an insertion direction of the fixing unit.

Formed at the storage part is a receiving part supporting a portion of the bearing of the driving input gear projected from the gear cover, being formed in a manner so as to extend in the insertion direction of the fixing unit, and receiving the bearing while guiding movement of the bearing in the insertion direction when the fixing unit is inserted into the storage part.

The receiving part is provided with a storage side engagement part engaging with the cover side engagement part to regulate the movement of the bearing in the insertion direction when the receiving part is guiding the movement.

DETAILED DESCRIPTION

Embodiment

<Outline>

An image forming apparatus of this embodiment is the one which is provided with a fixing unit having a mechanism capable of selectively executing driving of a roller or operation of varying fixing nip pressure by switching a rotation direction of one driving input gear, wherein a bearing supporting a rotation axis of the driving input gear is provided on a fixing unit side, for example, a supporting gear cover is provided in a long hole, the gear cover is provided with a cover side engagement part to be described later on, a receiving section supporting the bearing of the gear is provided on a main body side, and this receiving part is provided with a storage side engagement part engaging with the cover side engagement part, thereby suppressing dislocation of the fixing unit attached to the main body of the image forming apparatus from its attachment position which dislocation is likely to occur at time of the switching of the rotation direction of the driving input gear.

<Overall Configuration>

Figure 1:
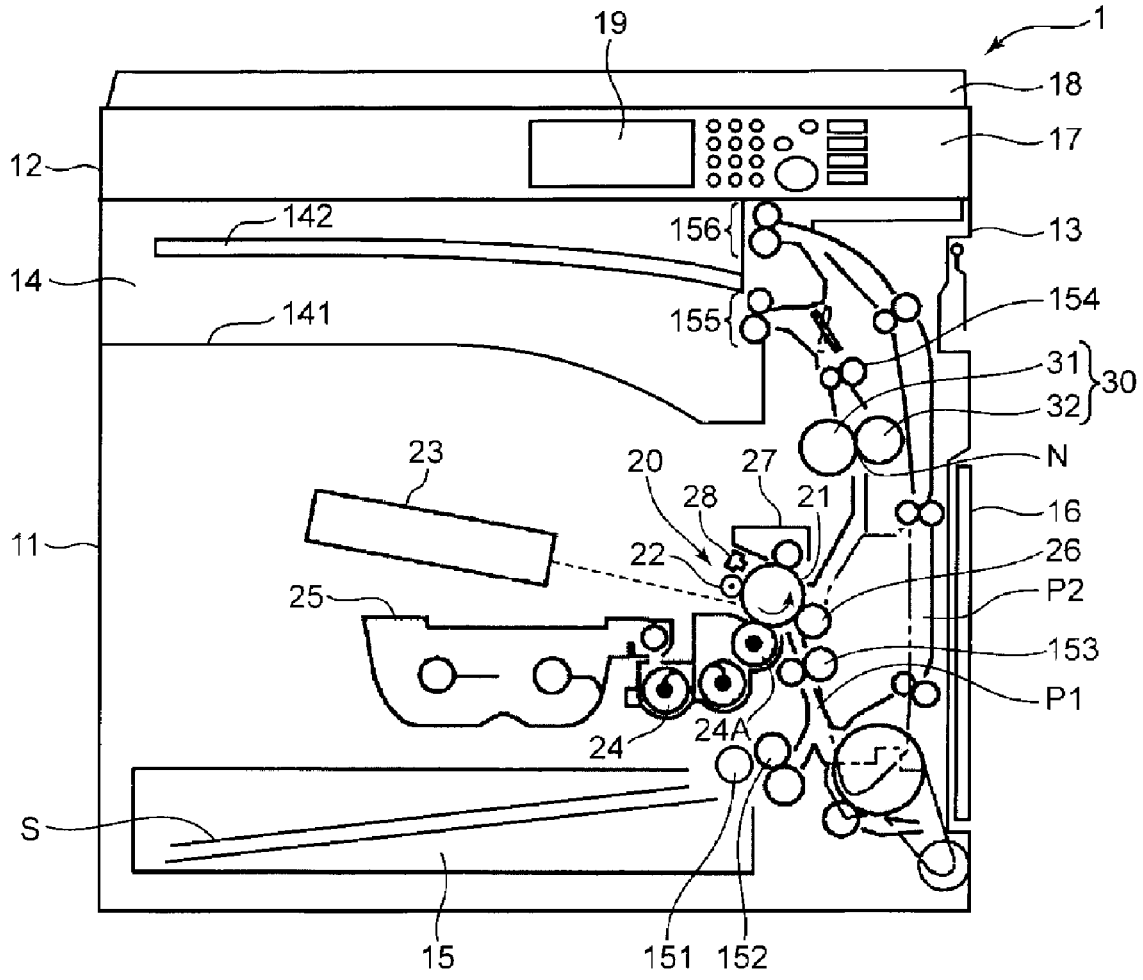
FIG. 1 is a view showing an outline of an image forming apparatus according to this embodiment.

FIG. 1 is a view showing an outline of the image forming apparatus 1 according to this embodiment. The image forming apparatus 1 is a black and white printer provided with a copy function, and includes: a main body housing part 11, a scanner housing part 12, a coupling housing part 13, and an intra-paper discharge part 14.

The main body housing part 11 is located at a bottom of the image forming apparatus 1, and includes: a paper feed cassette 15, a manual feed tray 16, an image formation unit 20, a pick-up roller 151, a paper feed roller pair 152, and a registration roller pair 153.

The paper feed cassette 15 stores document sheets S. The pick-up roller 151 feeds the document sheets S in the paper feed cassette 15 individually from a top. The paper feed roller pair 152 sends the document sheet S to an upstream end of a main conveyance path P1. The registration roller pair 153 sends the document sheet S to the image formation unit 20.

The manual feed tray 16 supplies a manually fed document sheet upon manual paper feed. The manually fed document sheet loaded on the manual feed tray 16 is sent to an upstream end of the main conveyance path P1. Here, the main conveyance path P1 is a conveyance path for the document sheets and the manually fed document sheets from the paper feed roller pair 152 up to the intra-paper discharge part 14, and an inverted conveyance path P2 is a conveyance path used for inverting the sheet upon double-sided printing.

The image formation unit 20 includes: a photoconductive drum 21, a charging device 22, an exposure device 23, a developing device 24, a toner container 25, a transfer roller 26, a cleaning device 27, and a neutralizer 28, and forms a toner image on the document sheet S or the manually fed document sheet.

The photoconductive drum 21 rotates around a rotation axis, and includes a circumferential surface on which an electrostatic latent image and a toner image are formed. The charging device 22 evenly charges the circumferential surface of the photoconductive drum 21. The exposure device 23 irradiates the circumferential surface of the photoconductive drum 21 with laser light to form an electrostatic latent image. The developing device 24 includes a developing roller 24A which supplies a toner to the circumferential surface of the photoconductive drum 21, and develops the electrostatic latent image formed on the photoconductive drum 21. The toner container 25 stores a toner to be refilled in the developing device 24. The transfer roller 26 forms a transfer nip part with the photoconductive drum 21, and transfers, onto the document sheet S or the manually fed document sheet, the toner image formed on the photoconductive drum 21. The cleaning device 27 cleans the circumferential surface of the photoconductive drum 21 on which the toner image has already been transferred. The neutralizer 28 irradiates neutralizing light to the circumferential surface of the photoconductive drum 21 on which the toner image has already been transferred to thereby achieve neutralization.

The scanner housing part 12 is located at a top of the image forming apparatus 1, stores a scanner unit 17, and includes: contact glass (not shown) fitted in a top surface of the scanner unit 17; a press cover 18; and an operation panel 19.

The scanner unit 17 includes: an image-taking element, a light source, a mirror and a lens (all not shown), etc., irradiates light of the light source to an image on a reading object (hereinafter referred to as "document") placed on the contact glass, and guides reflective light to the image-taking element with the mirror and the lens to thereby optically read the light, generating image data.

The press cover 18 suppresses floating of the document placed on the contact glass, and also covers the document and the contact glass in order to avoid entrance of unnecessary external light.

The operation panel 19 is exposed in front of the scanner housing part 12, includes an LCD touch panel and ten keys, and receives, from the user, various operations performed on the image forming apparatus 1.

The coupling housing part 13 is arranged between the body housing part 11 and the scanner housing part 12, stores a fixing unit 30, and includes a first sheet exhaust port 155 and a second sheet exhaust port 156.

The fixing unit 30 includes: a fixing roller 31, a pressure roller 32, and a sheet conveyance roller 154, and sandwiches the sheet, on which the toner image has been formed in the image formation unit 20, between two rollers of the fixing roller 31 and the pressure roller 32, then pass the sheet therebetween (hereinafter referred to as "a fixing nip part") to thereby heat and pressurize the sheet, and welds the toner onto the sheet, thereby fixing the toner image.

The fixing roller 31 is a metallic cylindrical roller, and includes therein a heat generating body such as a halogen heater.

The pressure roller 32 is a roller having an elastic layer so formed as to be pressed against the fixing roller 31 to ensure the fixing nip part N between the pressure roller 32 and the fixing roller 31, and has, on outer circumference of a core shaft such as a cylindrical pipe of iron steel or aluminum, an elastic heat-insulating layer of, for example, silicon rubber and a mold-releasing layer of, for example, fluorine resin which are superposed on each other. In this embodiment, a rotational driving force is given to the fixing roller 31, and the pressure roller 32 rotates following the rotation of the fixing roller 31. Details of the fixing unit 30 will be described later on.

The intra-paper discharge part 14 is an intra-space into which the sheet already subjected to image formation is discharged, is surrounded by an upper surface of the main body housing part 11, a lower surface of the scanner housing part 12, and a left surface of the coupling housing part 13, and has: an intra-paper discharge tray 141 on which the sheet already subjected to image formation and discharged from the first sheet exhaust port 155 is accumulated; and a sub-paper-discharge tray 142 on which the sheet already subjected to image formation and discharged from the second sheet exhaust port 156 is accumulated.

<Details of Fixing Unit>

Figure 2:
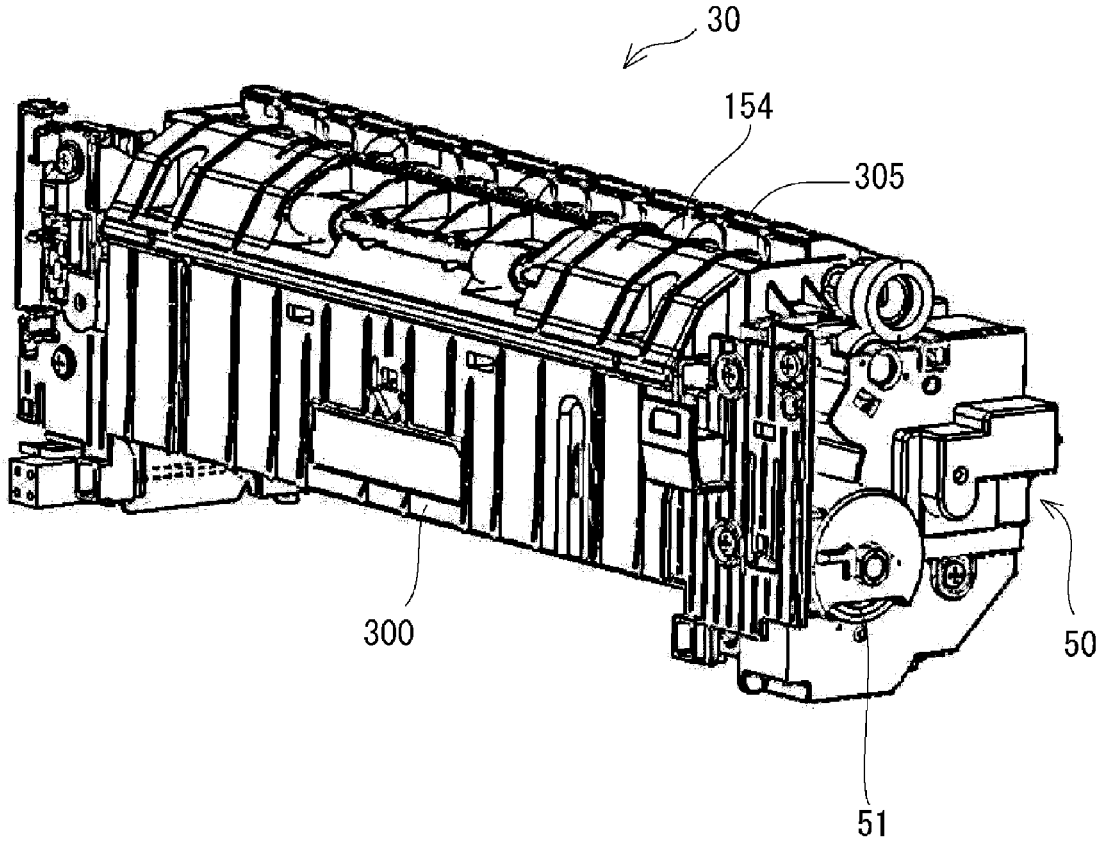
FIG. 2 is a view showing outer appearance of a fixing unit.
Figure 3:
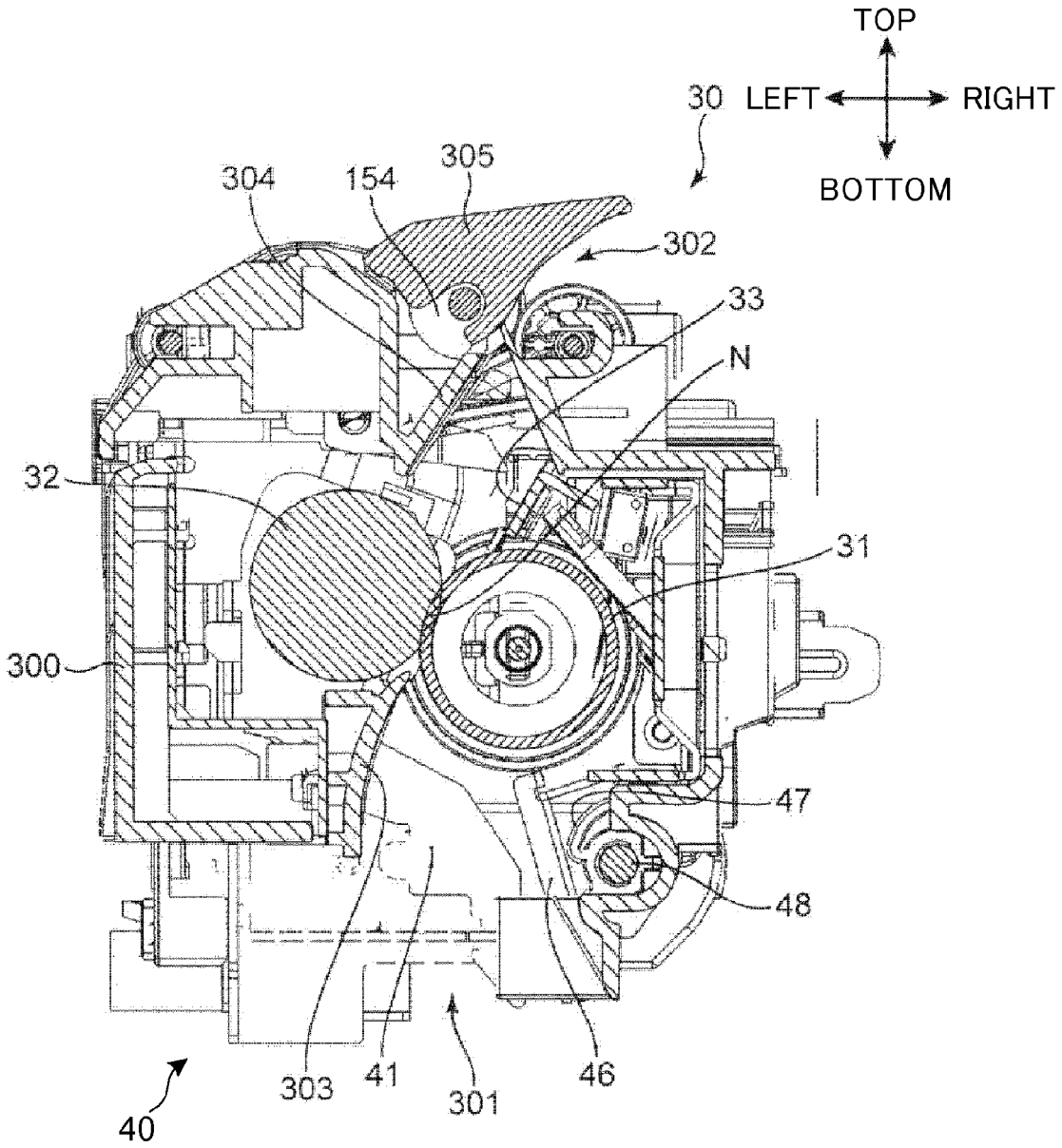
FIG. 3 is a view showing a horizontal cross section of the fixing unit shown in FIG. 2.

FIG. 2 is a view showing outer appearance of the fixing unit 30. FIG. 3 is a view showing a horizontal cross section of the fixing unit 30 shown in FIG. 2.

As shown in FIG. 2, the fixing unit 30 further includes: a fixing housing 300, a pressure adjustment mechanism 40 (not shown in FIG. 2), a driving input gear 51, and a transmission mechanism 50

As shown in FIG. 3, the fixing housing 300 receives, through an inlet opening 301, the sheet on which the toner image has been formed in the image formation unit 20, and sends, from an outlet opening 302, the sheet already subjected to fixing processing. Moreover, arranged downstream of the inlet opening 301 is an upstream guide plate 303, which guides, towards the fixing nip part N, the sheet on which the toner image has been formed.

Moreover, arranged upstream of the outlet opening 302 is a downstream guide plate 304, which guides the sheet which has passed through the fixing nip part N and has already been subjected to the fixing processing. Further, arranged near the outlet opening 302 are a sheet conveyance roller 154 and a movable guide member 305. The sheet conveyance roller 154 sends, to the next process, the sheet already subjected to the fixing processing, and the movable guide member 305 guides the sheet which has already been subjected to the fixing processing and has been sent to the next process.

Arranged on a downstream side of the fixing nip part N in a rotation direction along outer circumference of the fixing roller 31 is a sheet separation member 33, which prevents the sheet, which has passed through the fixing nip part N, from being wound around a circumferential surface of the fixing roller 31.

The driving input gear 51 receives, from outside of the fixing unit 30: rotational power in a first direction for driving the two rollers forming the fixing nip part N; and rotational power in a second direction for activating the pressure adjustment mechanism 40 in a direction opposite to the first direction.

The transmission mechanism 50 is formed of a plurality of gears in combination, transmits, to the fixing roller 31, a rotational driving force given to the driving input gear 51, and also transmits this rotational driving force to the pressure adjustment mechanism 40. When the rotational power in the first direction is given to the driving input gear 51, the transmission mechanism 50 transmits this rotational power in the first direction to the two rollers forming the fixing nip part N without activating the pressure adjustment mechanism 40, and when the rotational power in the second direction opposite to the first direction is given to the driving input gear 51, the transmission mechanism 50 does not transmit this rotational power in the second direction to the two rollers while activating the pressure adjustment mechanism 40. Details of the driving input gear 51 and the transmission mechanism 50 will be described later on.

The pressure adjustment mechanism 40 is a mechanism which varies the fixing nip pressure between the two rollers forming the fixing nip part N, and more specifically, a mechanism which makes switching between a first posture making the two rollers in pressure-contact with each other with first pressure suitable for general-purpose paper (forming a normal-pressure state) and a second posture making the two rollers in pressure-contact with each other with second pressure lower than the first pressure (forming a reduced-pressure state). In this embodiment, the fixing roller 31 on a driving side is fixed, and a position of the only pressure roller 32 in a driven side is changed to switch the posture, thus not complicating a structure of the driving system.

<Description of Pressure Adjustment Mechanism>

Figure 4:
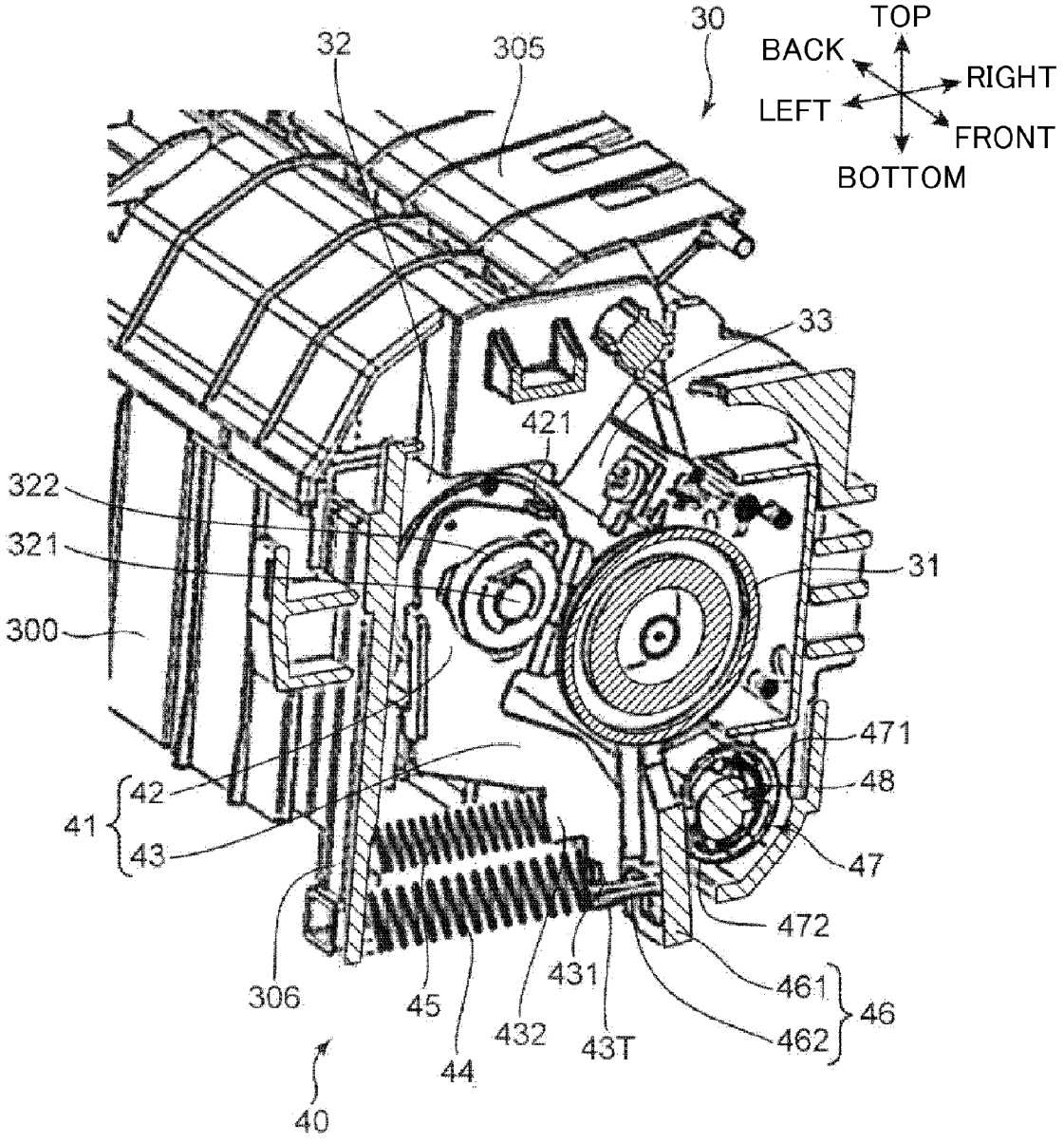
FIG. 4 is a view showing the fixing unit partially disassembled for a description of a pressure adjustment mechanism.
Figure 5B:
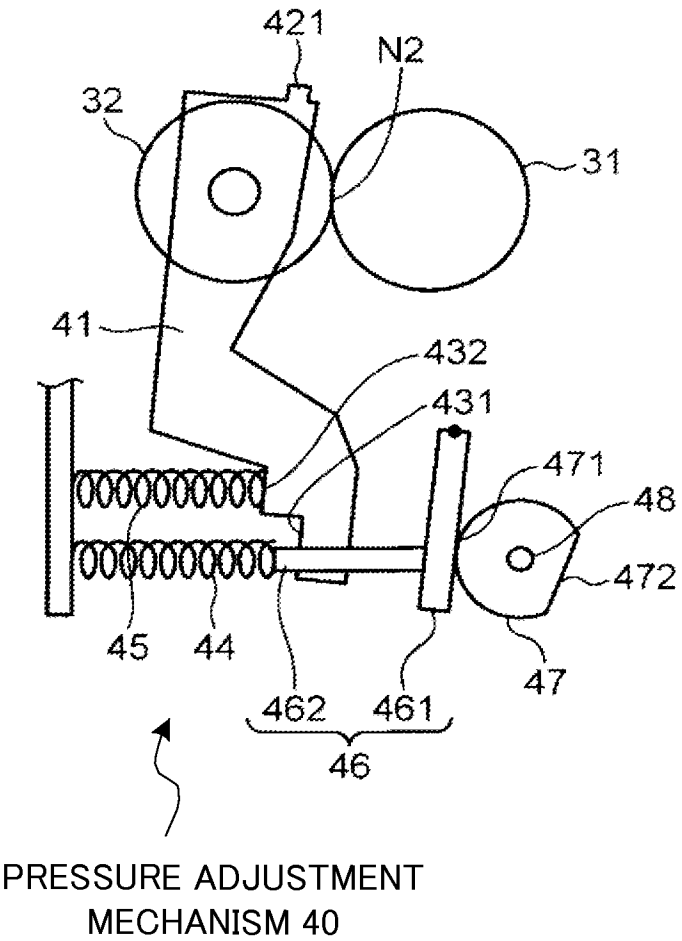
FIG. 5B is a view schematically showing condition of the fixing nip part in a reduced-pressure state.
Figure 5A:
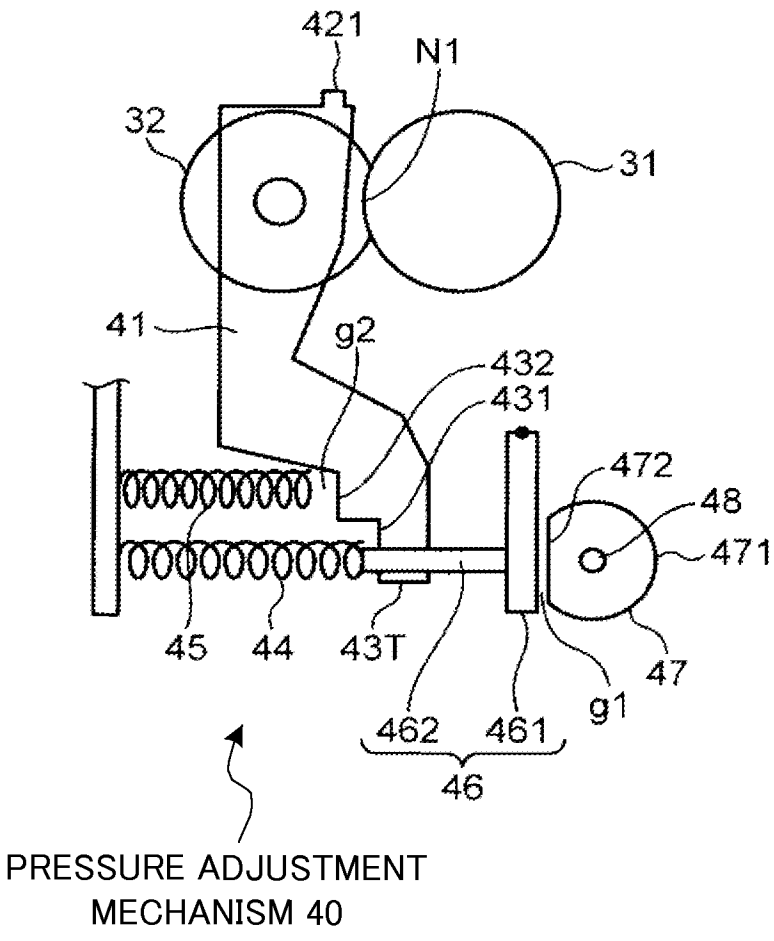
FIG. 5A is a view schematically showing condition of a fixing nip part in a normal-pressure state.

FIG. 4 is a view showing the fixing unit 30 partially disassembled for the description of the pressure adjustment mechanism 40. FIG. 5A is a view schematically showing condition of a fixing nip part N1 in the normal-pressure state. FIG. 5B is a view schematically showing condition of a fixing nip part N2 in the reduced-pressure state.

As shown in FIG. 4, the pressure adjustment mechanism 40 includes: a first movable member 41, a first elastic body 44, a second elastic body 45, a second movable member 46, a cam 47, a cam shaft 48, and a bearing 322, and these members form a position change mechanism of the pressure roller 32. These members forming the position change mechanism are arranged at both ends of the two rollers forming the fixing nip part N (only a front end side is shown in FIG. 4), and this position change mechanism supports the pressure roller 32 from the both ends and the position change mechanism on the front end side and the position change mechanism on a rear end side interlock with each other, thereby permitting smooth posture switching.

The first movable member 41 rotationally holds the pressure roller 32 and also moves upon posture switching, and includes a main body part 42 and a leg part 43. The main body part 42 has a locking part 421 serving as a supporting point upon movement, and holds a rotary shaft 321 of the pressure roller 32 serving as an operating point with a bearing 322 in between. The leg part 43 is a portion serving as main emphasis upon movement, and is so formed as to extend from the main body part 42 in a direction opposite to a position of the locking part 421 to thereby extend a distance from the supporting point to the main emphasis, providing strong fixing nip pressure with a relatively weak force.

The first elastic body 44 and the second elastic body 45 are, for example, coil springs (press springs), and are fixed at a base frame 306 as part of the fixing housing 300. The first elastic body 44 is arranged between a first pressure receiving part 431 located near an end part of the leg part 43 and the base frame 306, and the second elastic body 45 is arranged between a second pressure receiving part 432 located on a side closer to the supporting point than the first pressure receiving part 431 of the leg part 43 and the base frame 306. Here, action on the leg part 43 by an elastic force of the second elastic body 45 is weaker than action on the leg part 43 by an elastic force of the first elastic body 44 by an amount corresponding to an amount by which the second pressure receiving part 432 is located closer to the supporting point than the first pressure receiving part 431.

It is desirable that the elastic force of the second elastic body 45 be set weaker than the elastic force of the first elastic body 44 by, for example, projecting the second pressure receiving part 432 closer towards the base frame 306 than the first pressure receiving part 431 to make a length of the second elastic body 45 shorter than a length of the first elastic body 44.

The second movable member 46 includes: a cam receiving plate 461 and a fitting piece 462, and selectively disables action of either of the first elastic body 44 and the second elastic body 45 on the leg part 43 in accordance with rotation of the cam 47.

The cam receiving plate 461 has a supporting point at a top in FIG. 4, and moves with its right surface receiving a circumferential surface of the cam 47 in FIG. 4.

The fitting piece 462 is projected from the cam receiving plate 461 towards the first elastic body 44, and has a long hole in a horizontal direction in FIG. 4 so as to be movable while locking a lower end part 43T of the leg part 43 therein.

The cam 47 has a circumferential surface having a long length part 471 and a short length part 472, and this circumferential surface is provided at a position in contact with the cam receiving plate 461 (to immediate right of the cam receiving plate 461 in FIG. 4) and moves the second movable member 46. The cam shaft 48 is a rotary shaft of the cam 47, and the cam shaft 48 and the cam 47 are integrated together and thus rotation of the cam shaft 48 results in simultaneous movement of the cam 47.

A description will be given referring to FIGS. 5A and 5B.

As shown in FIG. 5A, in the normal-pressure state, the short length part 472 of the cam 47 opposes the cam receiving plate 461 of the second movable member 46, and there is a gap g1 between the cam 47 and the cam receiving plate 461, so that the second movable member 46 does not act on the first elastic body 44. Moreover, there is a gap g2 between the second elastic body 45 and the second pressure receiving part 432, and the second elastic body 45 does not act on the first movable member 41. Therefore, the first elastic body 44 has the elastic force acting on the first pressure receiving part 431 via the fitting piece 462 and presses the first movable member 41 counterclockwise with the locking part 421 as a supporting point, thereby forming the fixing nip part N1. Here, the elastic force of the first elastic body 44 is previously and appropriately set in a manner such that the fixing nip pressure becomes first pressure suitable for general-purpose paper.

Specifically, the second elastic body 45 is not attached to the second pressure receiving part 432. In a state shown in FIG. 5A, the first elastic body 44 is so configured as to press the first pressure receiving part 431, via the fitting piece 462, to a position at which the second pressure receiving part 432 portion separates from an end part of the second elastic body 45.

On the other hand, as shown in FIG. 5B, in the depressurized state, the long length part 471 of the cam 47 is in contact with the cam receiving plate 461 of the second movable member 46, and the second movable member 46 is pressed leftward in FIG. 5B, and a left end of the fitting piece 462 in FIG. 5B compresses the first elastic body 44. At this point, the first elastic body 44 is pressed by the fitting piece 462 until it becomes shorter than the second elastic body 45. Therefore, the first elastic body 44 does not act on the first movable member 41.

As a result, the gap between the second elastic body 45 and the second pressure receiving part 432 is no longer present, resulting in a state in which the first movable member 41 receives a pressure force provided by the second elastic body 45. As described above, the second elastic body 45 has the elastic force acting on the second pressure receiving part 432 not via the fitting piece 462, and presses the first movable member 41 counterclockwise with the locking part 421 as a supporting point, thereby forming the fixing nip part N2. Here, the elastic force of the second elastic body 45 is previously and appropriately set in a manner such that the fixing nip pressure becomes second pressure suitable for paper which is relatively not durable.

<Description of Transmission Mechanism>

Figure 6:
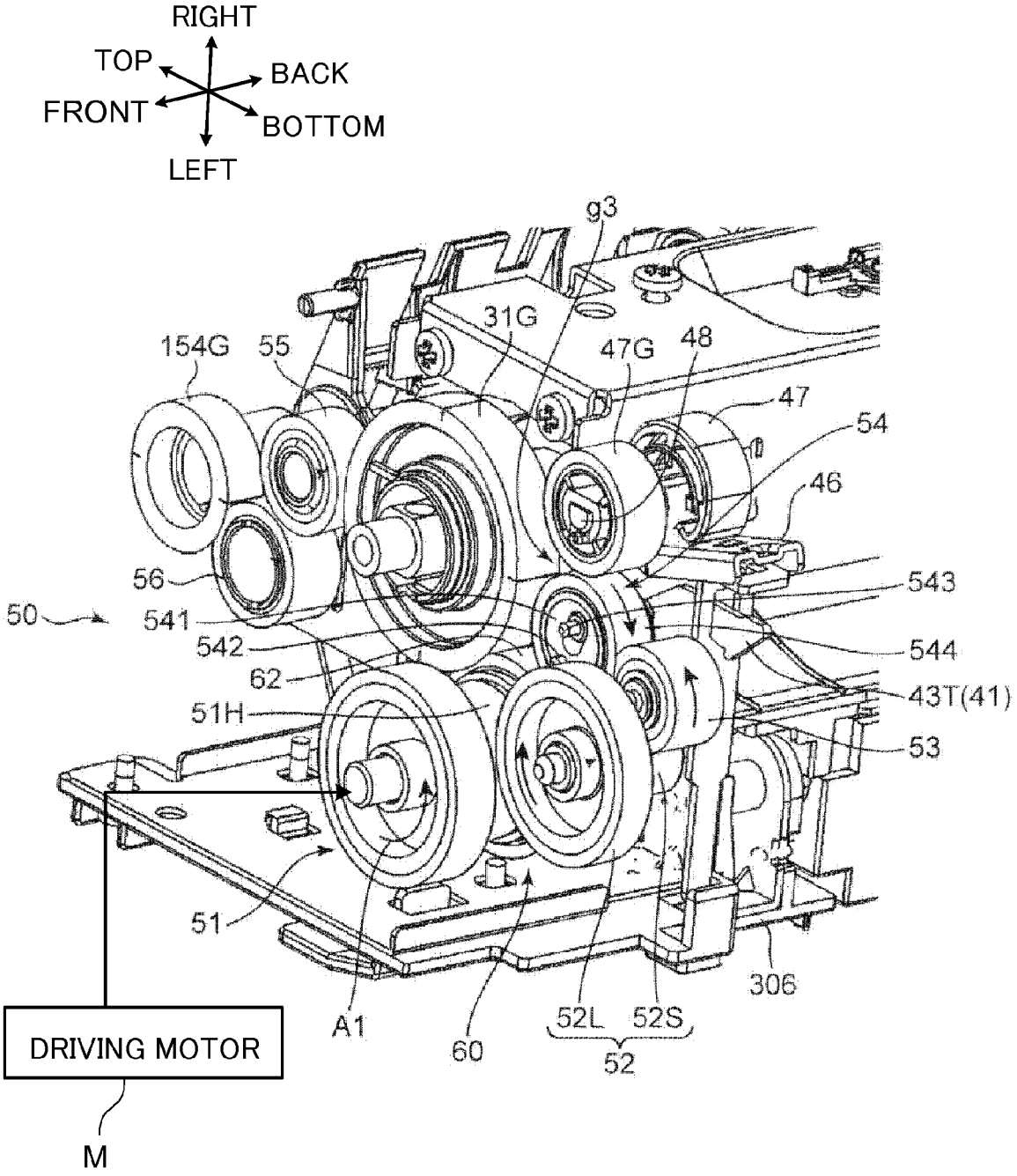
FIG. 6 is a view showing the fixing unit partially disassembled for a description of a transmission mechanism.

FIG. 6 is a view showing the fixing unit 30 partially disassembled for the description of the transmission mechanism 50.

Components of the transmission mechanism 50 is classified into: a fixing roller driving system for transmitting, to the fixing roller 31 via the driving input gear 51, a rotational driving force of a driving motor (not shown) lying outside of the fixing unit 30; and a nip pressure adjustment driving system for transmitting this rotational driving force to the cam shaft 48 of the pressure adjustment mechanism 40 via the driving input gear 51. Components of the fixing roller driving system include a ratchet mechanism 60. Components of the nip pressure adjustment driving system include: a first transmission gear 52, a second transmission gear 53, and a moving gear 54.

<Description of Fixing Roller Driving System>

In this embodiment, to operate the fixing roller driving system, a driving motor (a driving source outside of the fixing unit 30) M is normally rotated. This results in counterclockwise (a direction of an arrow A1 in FIG. 6) rotation of the driving input gear 51. On the other hand, to operate the nip pressure adjustment driving system, the driving motor is reversely rotated. This results in clockwise rotation (a direction opposite to the arrow A1 of FIG. 6) of the driving input gear 51.

Attached to an end part of the fixing roller 31 is a roller gear 31G. To this roller gear 31G, the rotational driving force is transmitted from the driving input gear 51 via the ratchet mechanism 60, whereby the fixing roller 31 rotates.

Attached to an end part of a sheet conveyance roller 154 (see FIG. 3) is a roller gear 154G. To this roller gear 1546, the rotational driving force is transmitted from the roller gear 31G via a third idle gear 55 and a fourth idle gear 56, whereby the sheet conveyance roller 154 rotates. Therefore, the rotation of the fixing roller 31 simultaneously rotates the sheet conveyance roller 154, whereby a sheet already subjected to the fixing processing is sent from the fixing housing 300.

<Details of Ratchet Mechanism>

Figure 7:
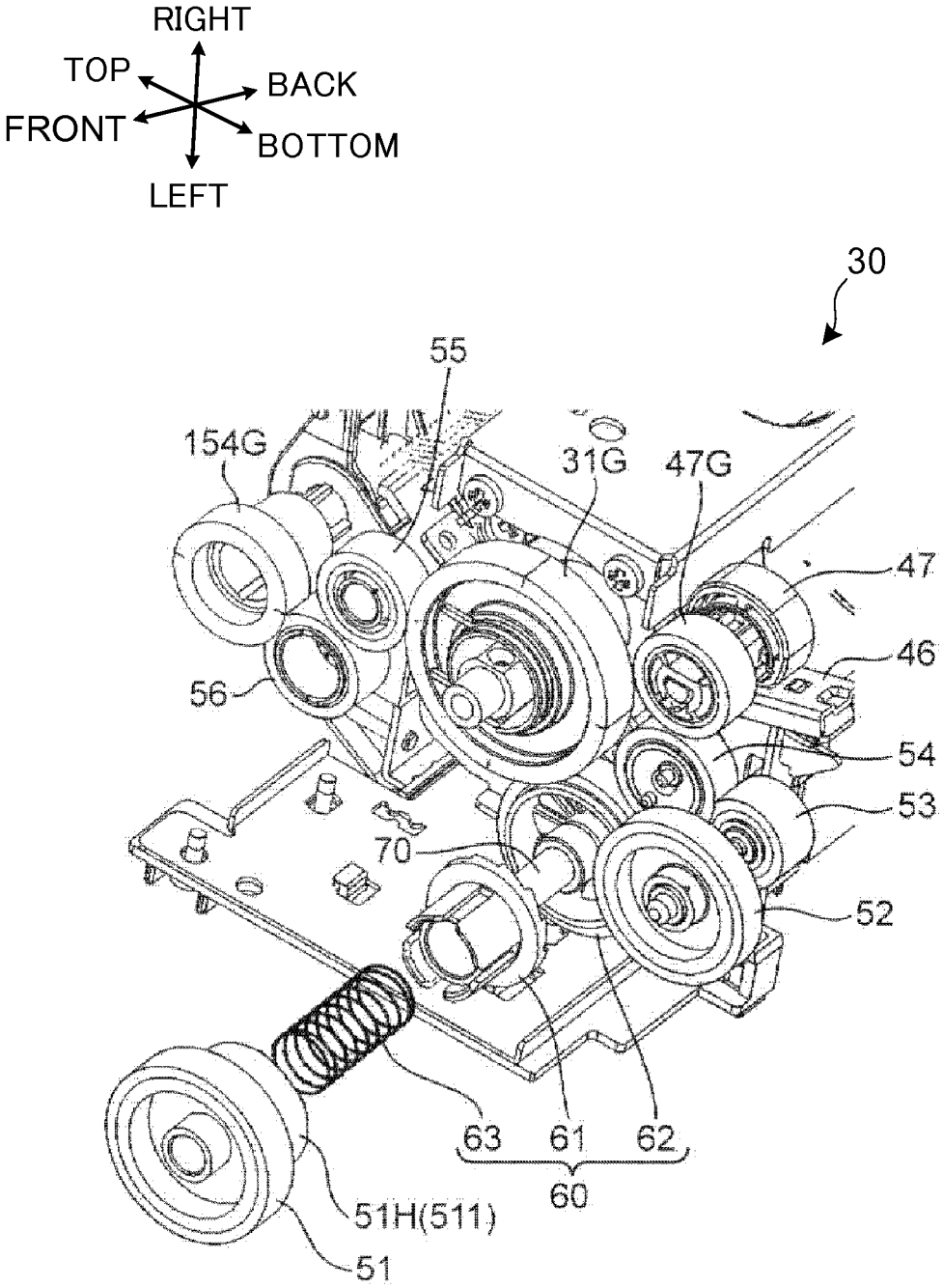
FIG. 7 is a view showing the fixing unit partially disassembled for a description of a ratchet mechanism.
Figure 8:
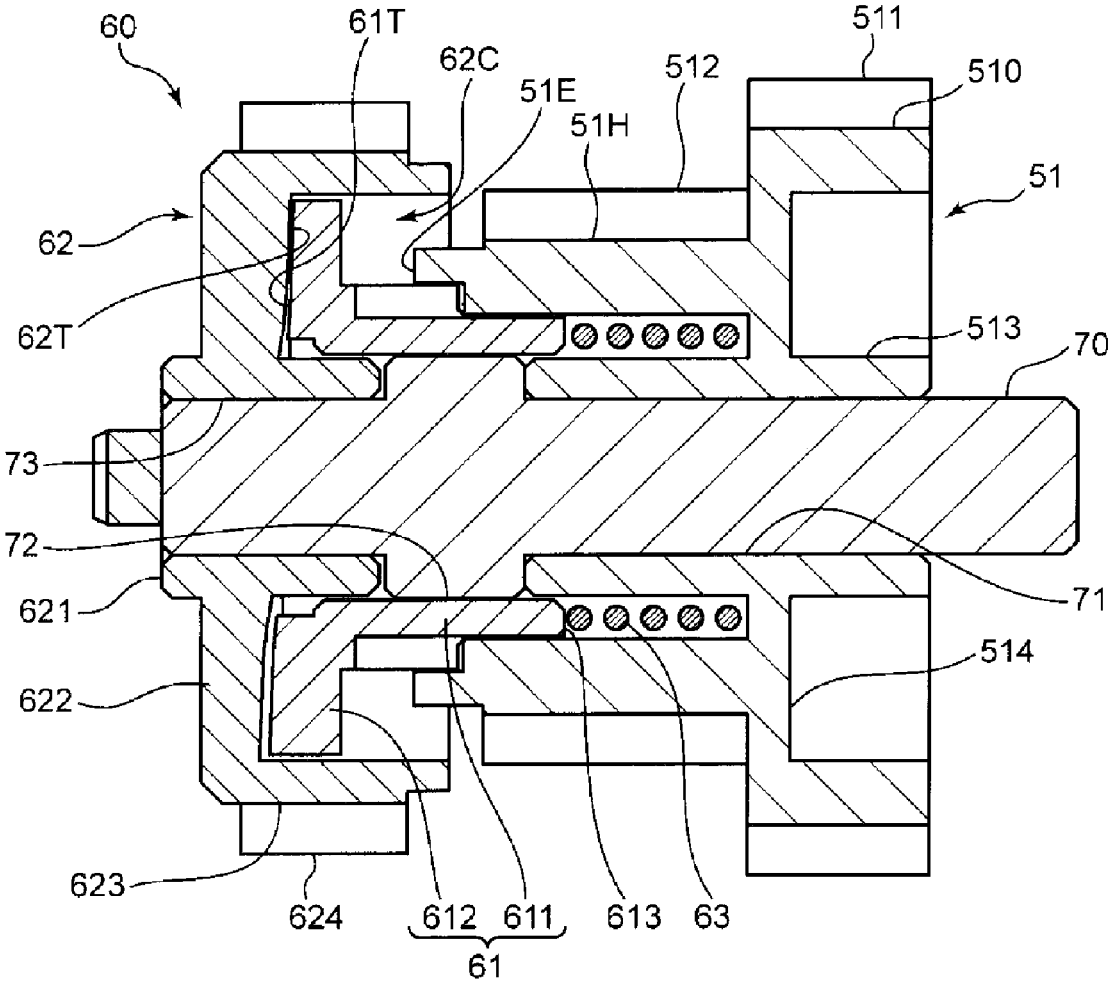
FIG. 8 is a view showing a cross section obtained by cutting the ratchet mechanism, a driving input gear, and their surroundings in a direction along a rotation axis.
Figure 9:
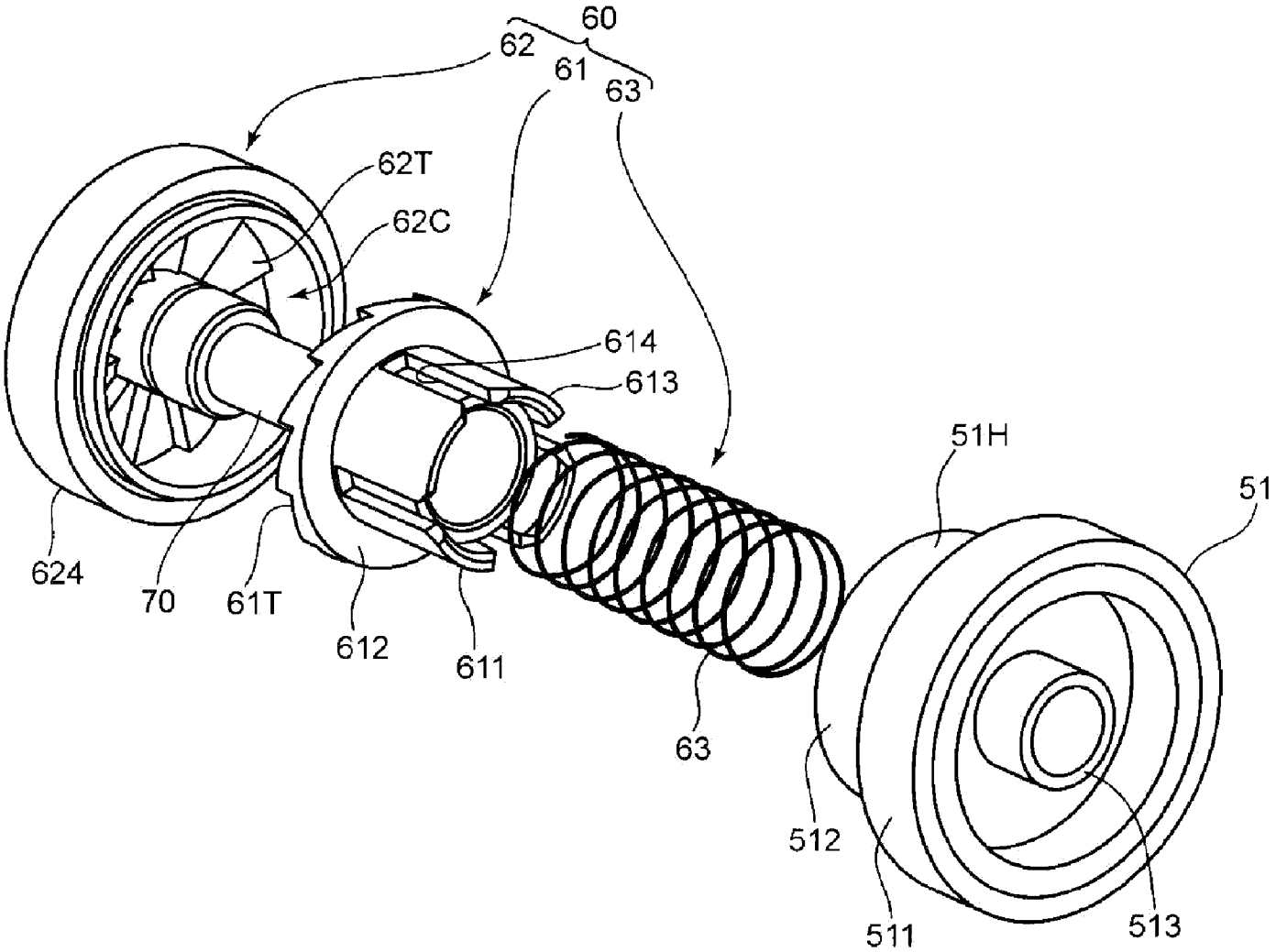
FIG. 9 is a view showing a disassembled state of the ratchet mechanism, the driving input gear, and their surroundings (part 1)
Figure 10:
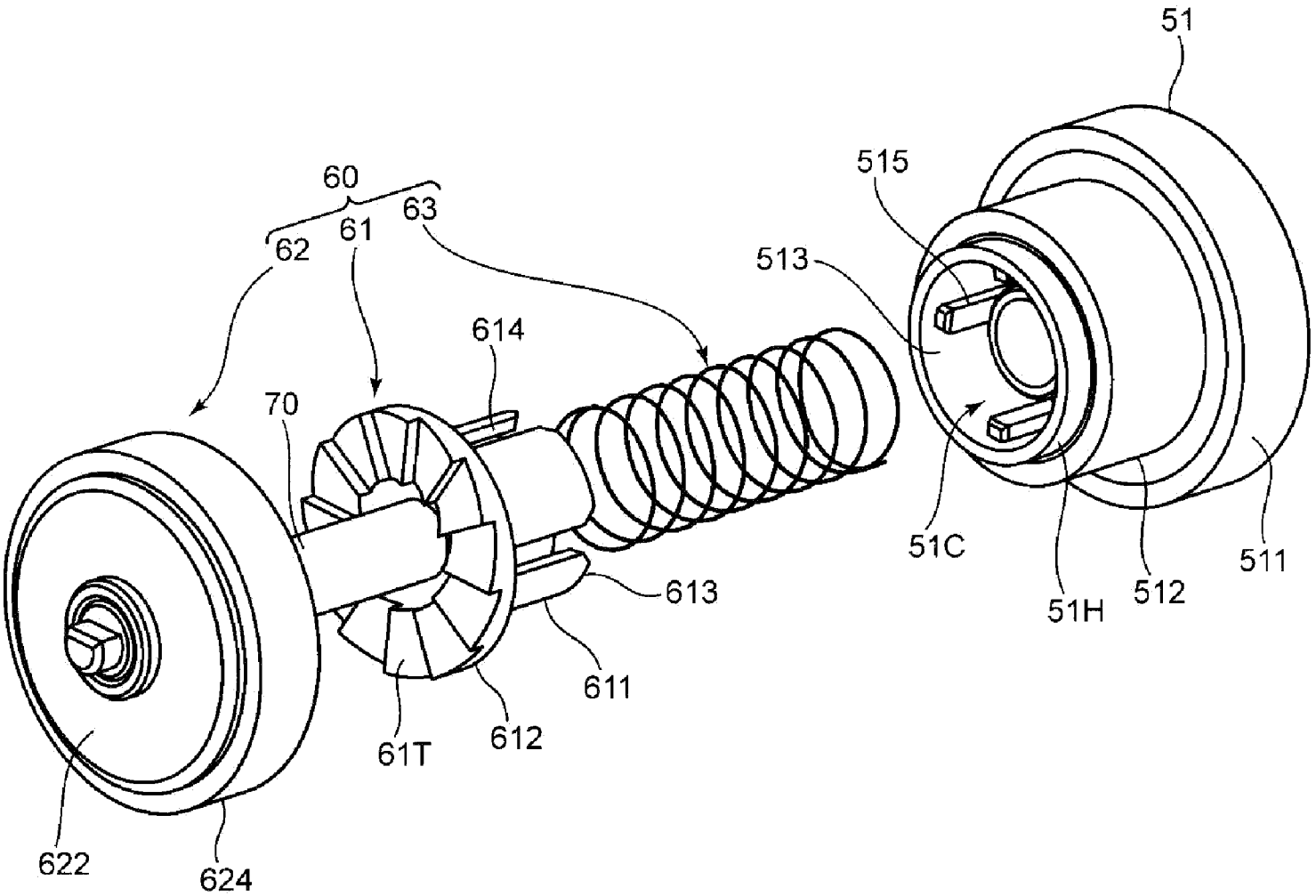
FIG. 10 is a view showing a disassembled state of the ratchet mechanism, the driving input gear, and their surroundings (part 2)

FIG. 7 is a view showing the fixing unit 30 partially disassembled for the description of the ratchet mechanism 60. FIG. 8 is a view showing a cross section obtained by cutting the ratchet mechanism 60, the driving input gear 51, and their surroundings in a direction along a rotation axis. FIGS. 9 and 10 are views showing the ratchet mechanism 60, the driving input gear 51, and their surroundings which are partially disassembled.

The ratchet mechanism 60 is assembled coaxially with the driving input gear 51, includes a ratchet joint 61, a ratchet gear 62, and a ratchet spring 63, and has a function of transmitting power to the roller gear 31G upon counterclockwise (the direction of the arrow A1 of FIG. 6) rotation of the driving input gear 51 and not transmitting the power to the roller gear 31G upon clockwise (the direction opposite to the arrow A1 of FIG. 6) rotation.

The ratchet joint 61 includes a body part 611 and a base part 612. The body part 611 is a cylindrical portion, and is provided on an outer circumferential surface thereof with a plurality of slits 614 extending in the direction along the rotation axis. Here, on an inner circumference side 613 near one end of the body part 611, one end of the ratchet spring 63 is received. The base part 612 is a discoid portion, on one surface of which a first ratchet tooth 61T having ratchet pieces arrayed in an annular form is formed and onto another surface of which another end of the body part 611 is attached.

The ratchet gear 62 includes: a boss part 621, a rim part 623, and a web part 622. The boss part 621 is a cylindrical portion, and is fitted and fixed in a rear end part 73 of a spindle 70. Therefore, the spindle 70 rotates together with the ratchet gear 62. On the other hand, the ratchet joint 61 and the driving input gear 51 do not rotate together with the spindle 70 in some cases. The rim part 623 is a cylindrical portion of a diameter larger than that of the boss part 621. On an outer circumferential surface of the rim part 623, a gear tooth 624 is carved, and is so arranged as to mate with the roller gear 31G. The web part 622 is a portion coupling together the boss part 621 and the rim part 623, on an inner surface of which a second ratchet tooth 62T having a plurality of ratchet pieces arrayed in an annular form is formed. In this embodiment, a size and an array pitch of the ratchet pieces of the second ratchet tooth 62T are made equal to those of the ratchet pieces of the first ratchet tooth 61T, strengthening a mating force to improve endurance.

The ratchet spring 63 is formed of, for example, a coil spring, and is assembled while compressed between the driving input gear 51 and the ratchet joint 61, and normally presses the ratchet joint 61 against the ratchet gear 62. Therefore, the first ratchet tooth 61T and the second ratchet tooth 62T are pressed by the ratchet spring 63.

If a counterclockwise rotational driving force is given to the driving input gear 51, the first ratchet tooth 61T and the second ratchet tooth 62T do not mate with each other and slide, and thus the rotational driving force of the driving input gear 51 is transmitted to the ratchet gear 62, and the fixing roller 31 rotates.

On the other hand, if a clockwise rotational driving force is given to the driving input gear 51, the first ratchet tooth 61T and the second ratchet tooth 62T slide, and thus the rotational driving force of the driving input gear 51 is not transmitted to the ratchet gear 62 and the fixing roller 31 does not rotate. However, upon the sliding of the first ratchet tooth 61T and the second ratchet tooth 62T, every time the driving input gear 51 rotates a number of times corresponding to the array pitch of the ratchet teeth, clicking sound is generated upon actuation of the ratchet, raising a concern that discomfort is given to the user. However, in this embodiment, the first ratchet tooth 61T and the second ratchet tooth 62T make contact with each other in a cavity 62C of the ratchet gear 62, and a large portion of an opening of the cavity 62C is covered with an end edge 51E of a housing part 51H and an end edge of a second gear tooth 512, thus resulting in a structure such that the clicking sound generated upon actuation of the ratchet hardly leaks outside, which is therefore less likely to give discomfort to the user.

<Details of Driving Input Gear>

As shown in FIG. 8, the driving input gear 51 includes: a large diameter part 510, the housing part 51H of a diameter smaller than that of the large diameter part 510; a boss part 513 of a diameter smaller than that of the housing part 51H; and a web part 514 of a discoid shape. Moreover, on an outer circumferential surface of the large diameter part 510, a flat first gear tooth 511 is craved, and similarly on an outer circumferential surface of the housing part 51H, a flat second gear tooth 512 is craved. In each figure of this embodiment, the individual gear teeth are omitted from the description. The boss part 513 is rotationally fitted in a front end part 71 of the spindle 70. The web part 514 couples together the boss part 513 and the large diameter part 510, and to a side surface of the web part 514, the housing part 51H is coupled. Further, on an inner circumferential surface of the web part 514, a projection 515 is provided which extends in the direction along the rotary axis. The projection 515 is approximately half fitted in the slit 614 of the body part 611, and the ratchet joint 61 and the driving input gear 51 rotate integrally.

<Description of Nip Pressure Adjustment Driving System>

As shown in FIG. 6, the first transmission gear 52 includes a large diameter part 52L and a small diameter part 52S, a gear tooth (not shown) of the large diameter part 52L of the first transmission gear 52 mates with the second gear tooth 512 of the driving input gear 51. Therefore, counterclockwise (the direction of the arrow A1 of FIG. 6) rotation of the driving input gear 51 results in clockwise rotation of the first transmission gear 52, and clockwise (the direction opposite to the arrow A1 of FIG. 6) rotation of the driving input gear 51 results in counterclockwise rotation of the first transmission gear 52.

A gear tooth (not shown) of the second transmission gear 53 mates with a gear tooth (not shown) of the small diameter part 52S of the first transmission gear 52. Therefore, the clockwise rotation of the first transmission gear 52 as a result of the counterclockwise (the direction of the arrow A1 of FIG. 6) rotation of the driving input gear 51 results in counterclockwise rotation of the second transmission gear 53, and the counterclockwise rotation of the first transmission gear 52 as a result of the clockwise (the direction opposite to the arrow A1 of FIG. 6) rotation of the driving input gear 51 results in clockwise rotation of the second transmission gear 53.

The moving gear 54 includes: a moving bobbin 541, a pin 542, a support pin 543, and a rotary gear 544. The moving bobbin 541 is a columnar member and includes the pin 542 projected to a front surface and a long hole penetrating in a direction along a center axis. When covered by a cover frame (not shown) assembled to the fixing housing 300, the pin 542 is fitted in the long hole provided at this cover frame. The support pin 543 is a columnar bump projected from the fixing housing 300. Here, the long hole portion is supported by the support pin 543 whereby the moving bobbin 541 can make parallel movement in a longitudinal direction of the long hole. When covered by the cover frame assembled to the fixing housing 300, the support pin 543 is closely fitted in the hole provided at the cover frame.

A rotary gear 544 is rotationally fitted in outer circumference of the moving bobbin 541. The moving bobbin 541 can make parallel movement but cannot rotate. The rotary gear 544 can rotate around the moving bobbin 541.

To an axial end of the cam shaft 48, a cam driving gear 47G is attached. To this cam driving gear 47G, the rotational driving force is transmitted from the driving input gear 51 via the transmission mechanism 50, whereby the cam shaft 48 rotates.

If a counterclockwise (the direction of the arrow A1 of FIG. 6) rotational driving force is given to the driving input gear 51, the second transmission gear 53 rotates counterclockwise as described above, so that the moving gear 54 moves in a direction separating from the cam driving gear 47G, resulting in a gap between the moving gear 54 and the cam driving gear 47G, and thus the moving gear 54 does not mate with the cam driving gear 47G. Therefore, the counterclockwise rotational driving force of the driving input gear 51 is not transmitted to the cam driving gear 47G, and the cam 47 does not rotate.

On the other hand, if a clockwise rotational driving force (the direction opposite to the arrow A1 of FIG. 6) is given to the driving input gear 51, the second transmission gear 53 rotates clockwise as described above, so that the moving gear 54 moves in a direction approaching the cam driving gear 47G and the moving gear 54 mates with the cam driving gear 47G. Therefore, the clockwise rotational driving force of the driving input gear 51 is transmitted to the cam driving gear 47G, and the cam 47 rotates.

<Description of Mechanism of Suppressing Escape of Fixing Unit>

Figure 11:
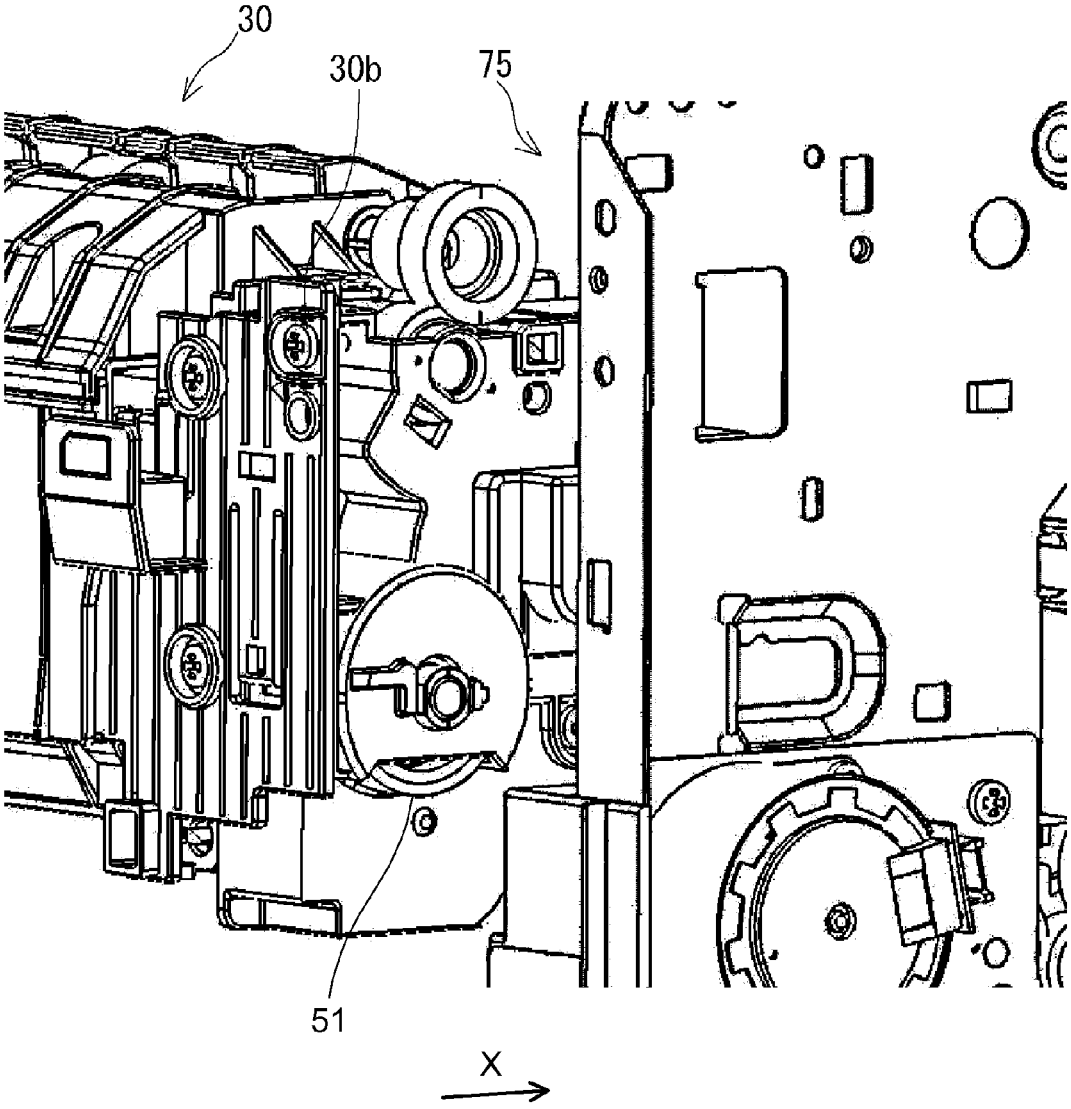
FIG. 11 is a view showing how the fixing unit is inserted into a fixing unit storage part of a main body of the image forming apparatus (part 1)
Figure 12:
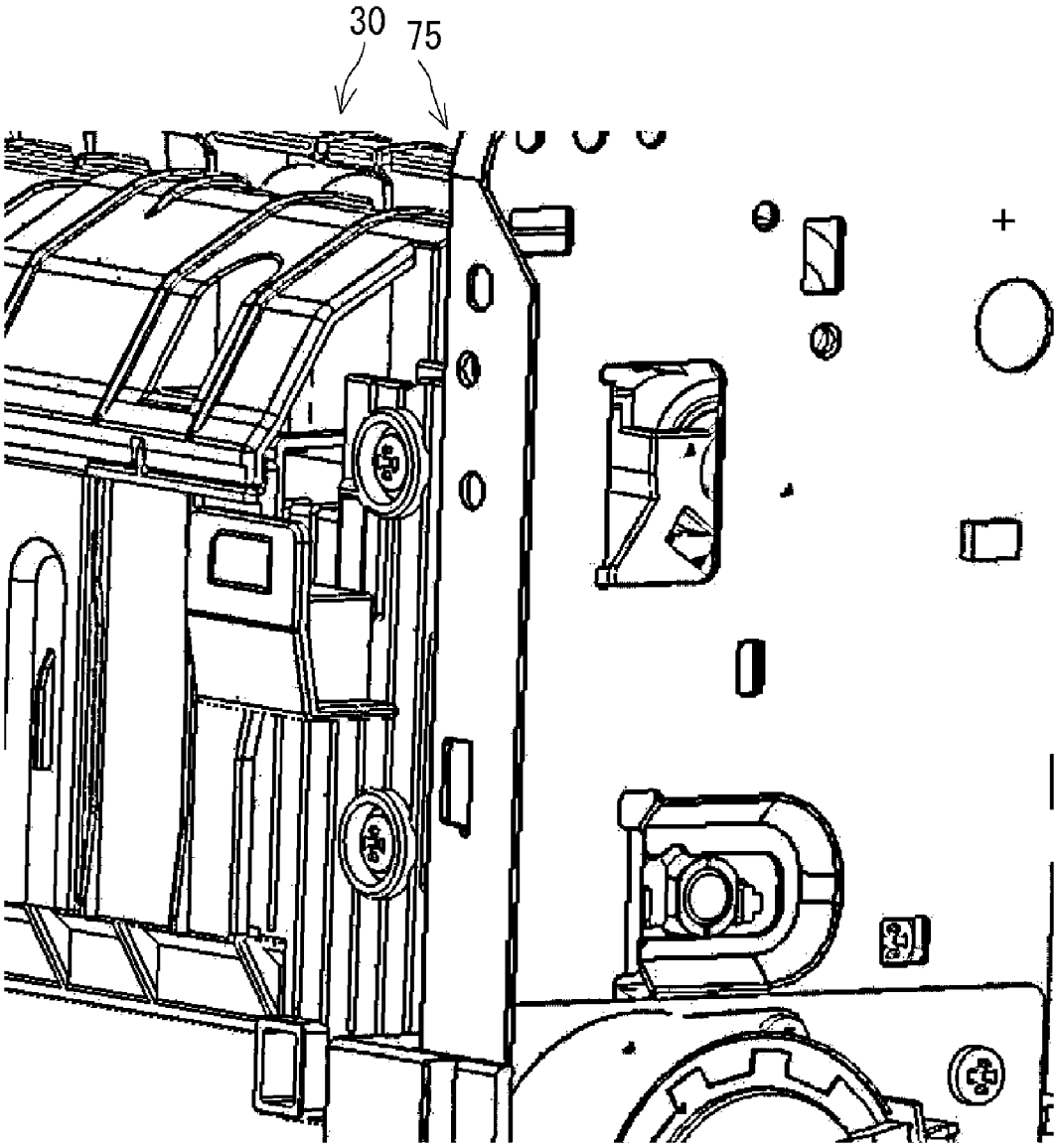
FIG. 12 is a view showing condition when the fixing unit is inserted into the fixing unit storage part of the main body of the image forming apparatus (part 2)
Figure 13:
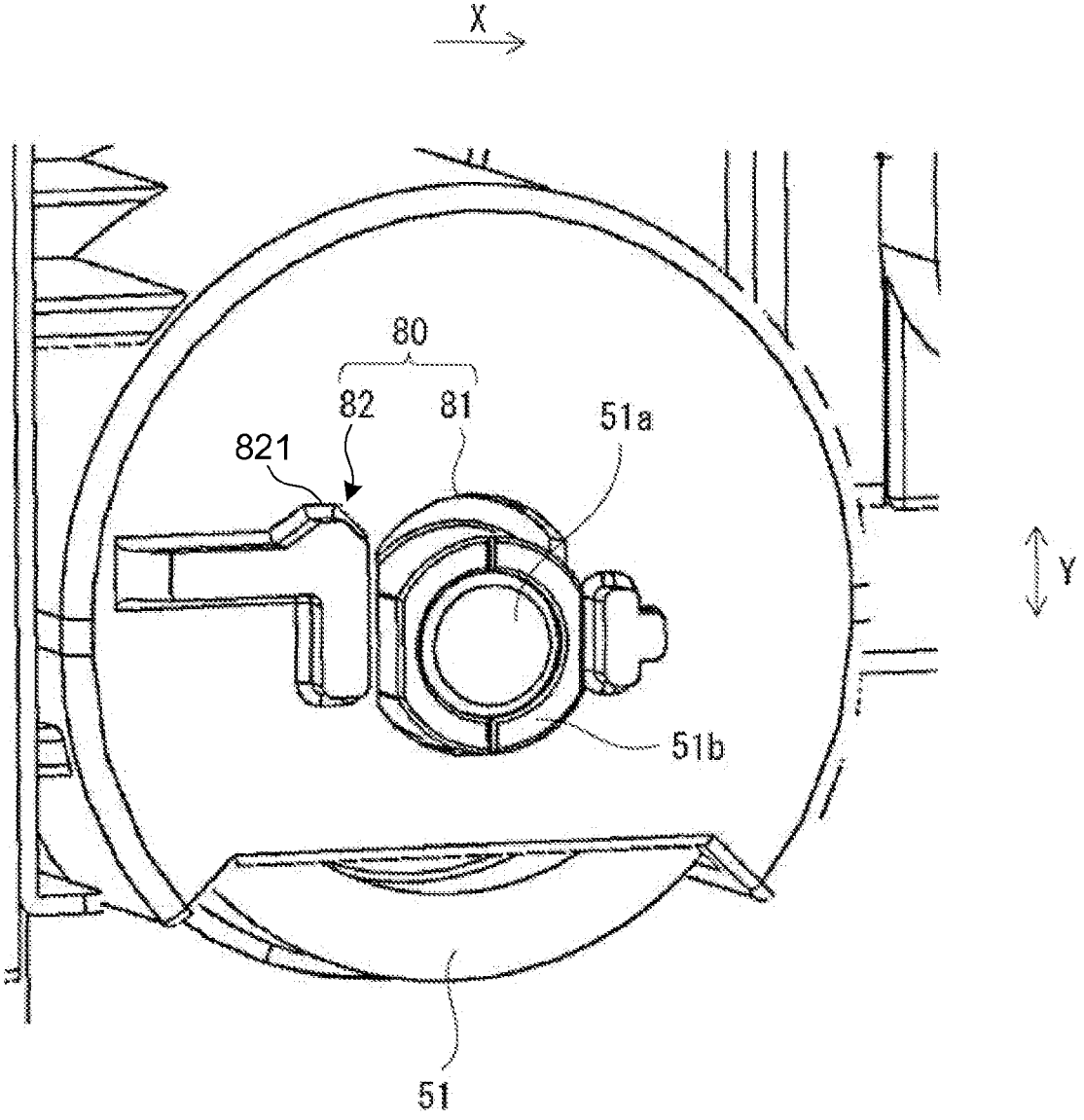
FIG. 13 is a view of a gear cover viewed from inside.
Figure 14:
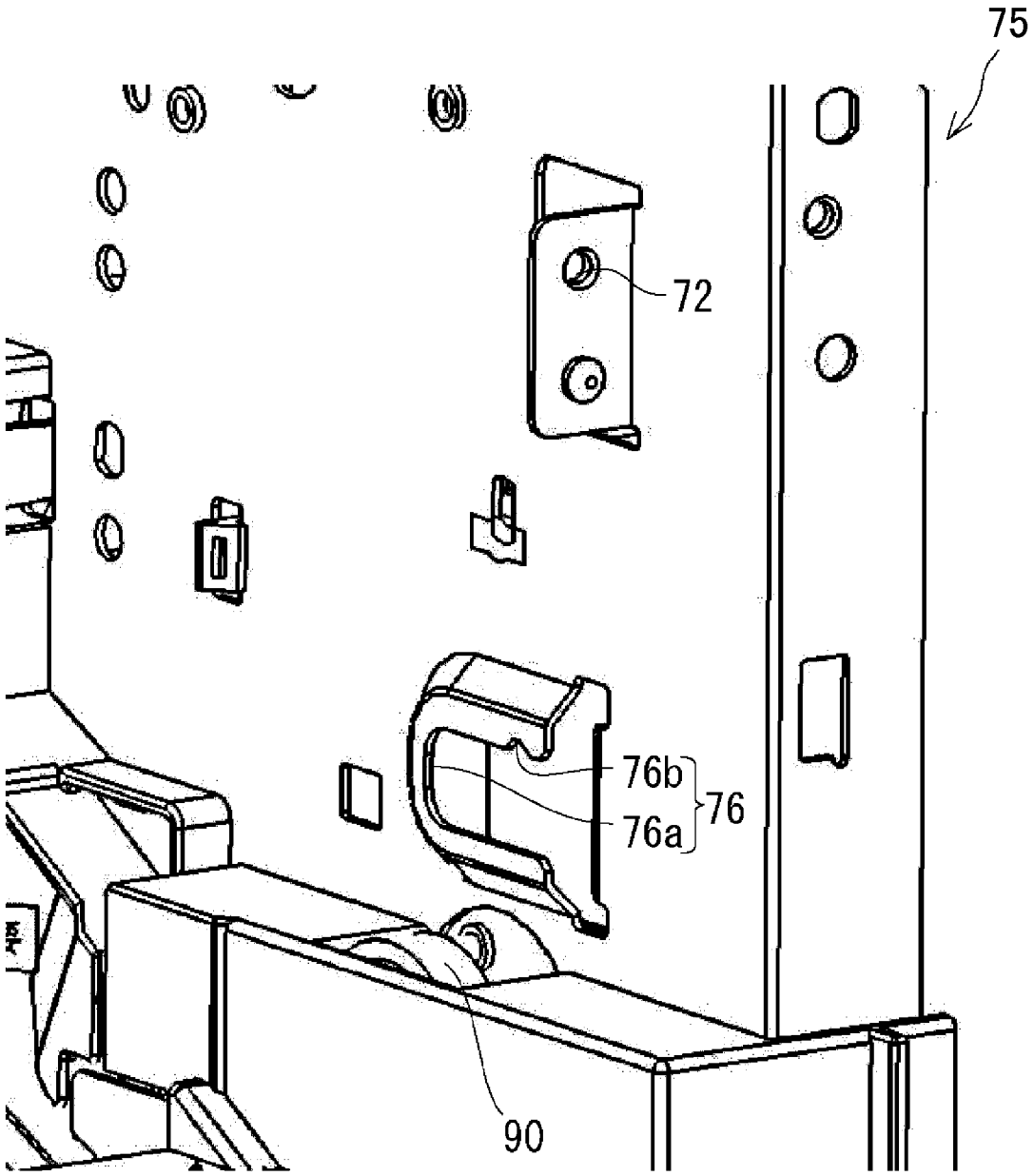
FIG. 14 is an enlarged view of a fixing unit receiving section.
Figure 15:
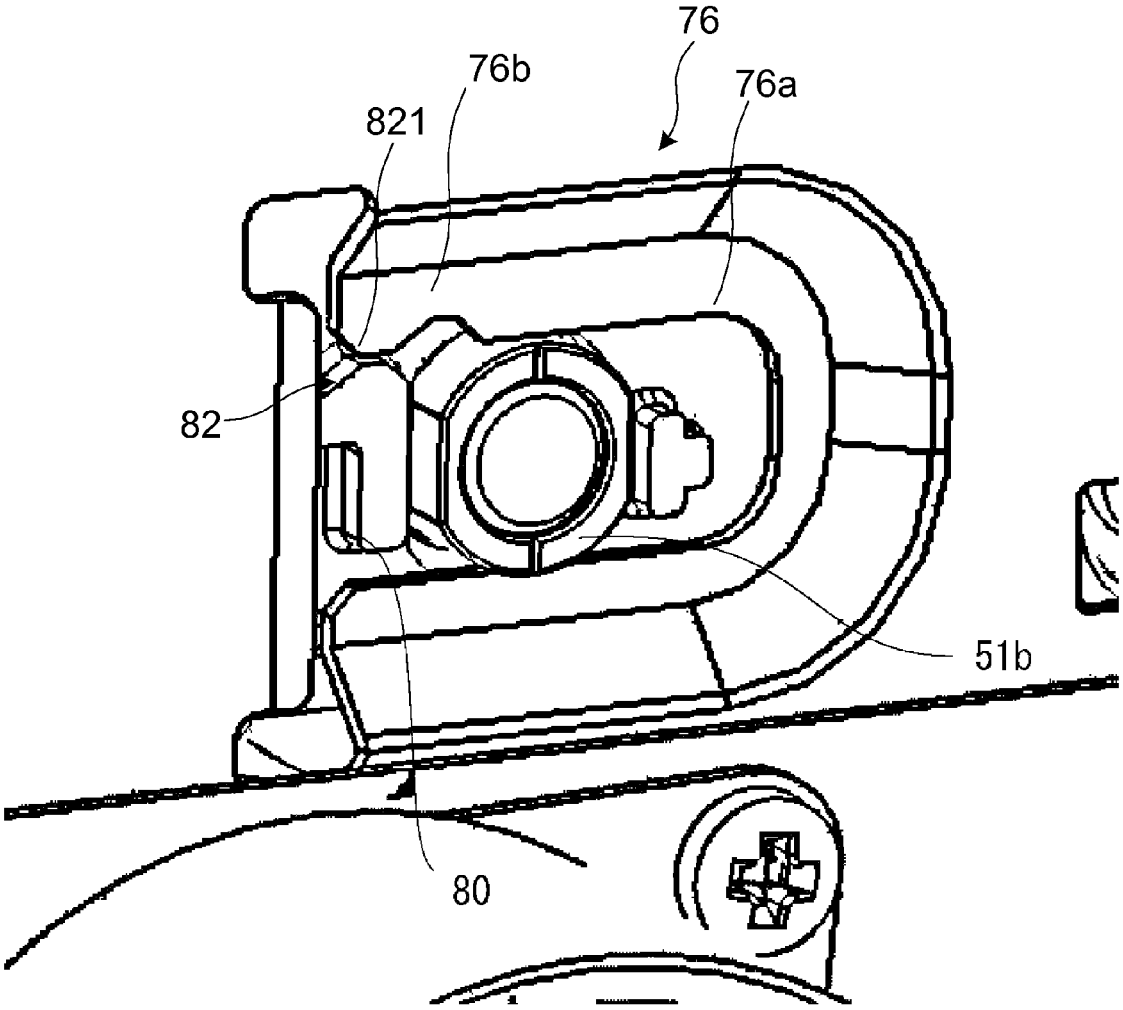
FIG. 15 is a view showing a gear cover and a driving input gear receiving part in a state in which the fixing unit has been inserted but has not yet been completely fixed.

FIGS. 11 and 12 are views showing condition when the fixing unit 30 is inserted into a fixing unit storage part 75 of the main body of the image forming apparatus 1. FIG. 13 is an enlarged view of a gear cover 80 as a main part involved in the storage of the fixing unit 30 on a fixing unit side. FIG. 14 is an inner view of a driving input gear receiving part 76 and a fixing part 72 as main parts of the fixing unit storage part 75 on the main body side of the image forming apparatus 1. FIG. 15 is a view of the gear cover 80 showing the gear cover 80 and the driving input gear receiving section 76 in a state in which the fixing unit 30 is inserted and completely fixed.

As shown in FIGS. 11 and 12, the image forming apparatus 1 includes: the fixing unit 30 and the fixing unit storage part 75 into which the fixing unit 30 is inserted.

Shown in FIG. 11 is condition when the fixing unit 30 is inserted into the fixing unit storage part 75 of the main body of the image forming apparatus 1. In this embodiment, the fixing unit 30 is moved and pushed in a substantially horizontal direction from a lateral side of the fixing unit storage part 75 towards inside of the fixing unit storage part 75.

Shown in FIG. 12 is condition when the fixing unit 30 is inserted into the fixing unit storage part 75 of the main body of the image forming apparatus 1 to the end. At this point, the driving input gear 51 on the fixing unit 30 side and a driving gear (not shown) on the main body side to which a driving force of the driving motor M is transmitted mate with each other, for example, in a state in which they are located vertically. An insertion direction is defined as a direction orthogonal to a vertical direction (perpendicular direction) based on easiness in positioning between the driving input gear 51 and the driving gear (easiness in obtaining a gear pitch).

As shown in FIG. 13, the gear cover 80 is a protection member of resin covering the driving input gear 51. The gear cover 80 supports a bearing 51*b*, which supports a rotary shaft 51*a* of the driving input gear 51, at a long hole 81 movable in a Y direction perpendicular to the insertion direction X of the fixing unit 30. At time of this support, the bearing 51*b* penetrates through the long hole 81, turning into a state in which it is projected in a direction in which the rotary shaft 51*a* extends.

The gear cover 80 has a cover side engagement part 82 protruding in a direction in which the spindle 70 extends on a side surface of the gear cover 80. The cover side engagement part 82 has a convex shape projected in the Y direction. That is, the cover side engagement part 82 is a convex part projected in the Y direction.

As shown in FIG. 13, before the fixing unit 30 is inserted, for example, the bearing 51*b* is in a state in which it has moved to a lowest part in the long hole 81, that is, a state in which the bearing 51*b* is most lowered with respect to the gear cover 80. That is, the bearing 51*b* is located at a lower end in the Y direction.

As shown in FIG. 14, the fixing unit storage part 75 is a frame for positioning the fixing unit 30 inserted in the main body of the image forming apparatus 1 in a fixed manner, and has the driving input gear receiving part 76 and the fixing part 72.

The driving input gear receiving part 76 is a metal fitting which suppresses dislocation of the fixing unit 30, which has been attached to the main body of the image forming apparatus 1, from its attachment position, which dislocation is likely to occur at time of switching of the rotation direction of the driving input gear 51. The driving input gear receiving part 76 has a receiving part 76*a* and a concave part 76*b*.

The receiving part 76*a* is a notch supporting the bearing 51*b* of the driving input gear 51 upon the insertion of the fixing unit 30. The notch extends in the same direction as the insertion direction X, and has the convex part 76*b* on its upper side. The receiving part 76*a* receives the bearing 51*b* while guiding movement of the bearing 51*b* in the insertion direction X upon the insertion of the fixing unit 30 into the fixing unit storage part 75. A dimension of the receiving part 76*a* in the Y direction is substantially equal to a dimension of the bearing 51*b* in the Y direction. This consequently reduces allowance between the bearing 51*b* and the receiving part 76*a*, and upon the insertion of the fixing unit 30 into the fixing unit storage part 75, the movement of the bearing 51*b* in the insertion direction X is guided while the movement in the Y direction is regulated by the receiving part 76*a*.

The convex part (storage side engagement part) 76*b*, while guiding the bearing 51*b* moving in the insertion direction X, engages with a convex shape 821 of the cover side engagement part 82 to regulate this movement. Specifically, the concave part 76*b*, upon fixation of the fixing unit 30 at the fixing unit storage part 75 after the insertion of the fixing unit 30 into the fixing unit storage part 75, fits with the convex shape 821 of the cover side engagement part 82. That is, fitting the convex shape 821 with the concave part 76*b* as shown in FIG. 16 fixes the fixing unit 30 at the fixing unit storage part 75.

The fixing part 72 here is formed of a hole part. When the concave part 76*b* and the convex shape 821 are fitted with each other and the fixing unit 30 is fixed at the fixing unit storage part 75, a screw hole (not shown) provided on the fixing unit 30 side and an opening of the fixing part 72 are lapped with each other, and the screw hole (not shown) and the fixing part 72 are screwed with a fixing screw 30*b* (described in FIG. 11) in this state. Through this screwing, the fixing unit 30 is firmly fixed at the fixing unit storage part 75, reliably suppressing the dislocation of the attachment position of the fixing unit 30 with respect to the fixing unit storage part 75.

It is preferable that the convex shape 821 of the cover side engagement part 82 be adjacent to an insertion direction X side of the long hole 81. Arrangement of the convex shape 821 at this position permits fixation of the gear cover 80 at the fixing unit storage part 75 at a position closest to the bearing 51*b* of the driving input gear 51, thus making it possible to efficiently suppress the aforementioned dislocation of the fixing unit 30.

Figure 16:
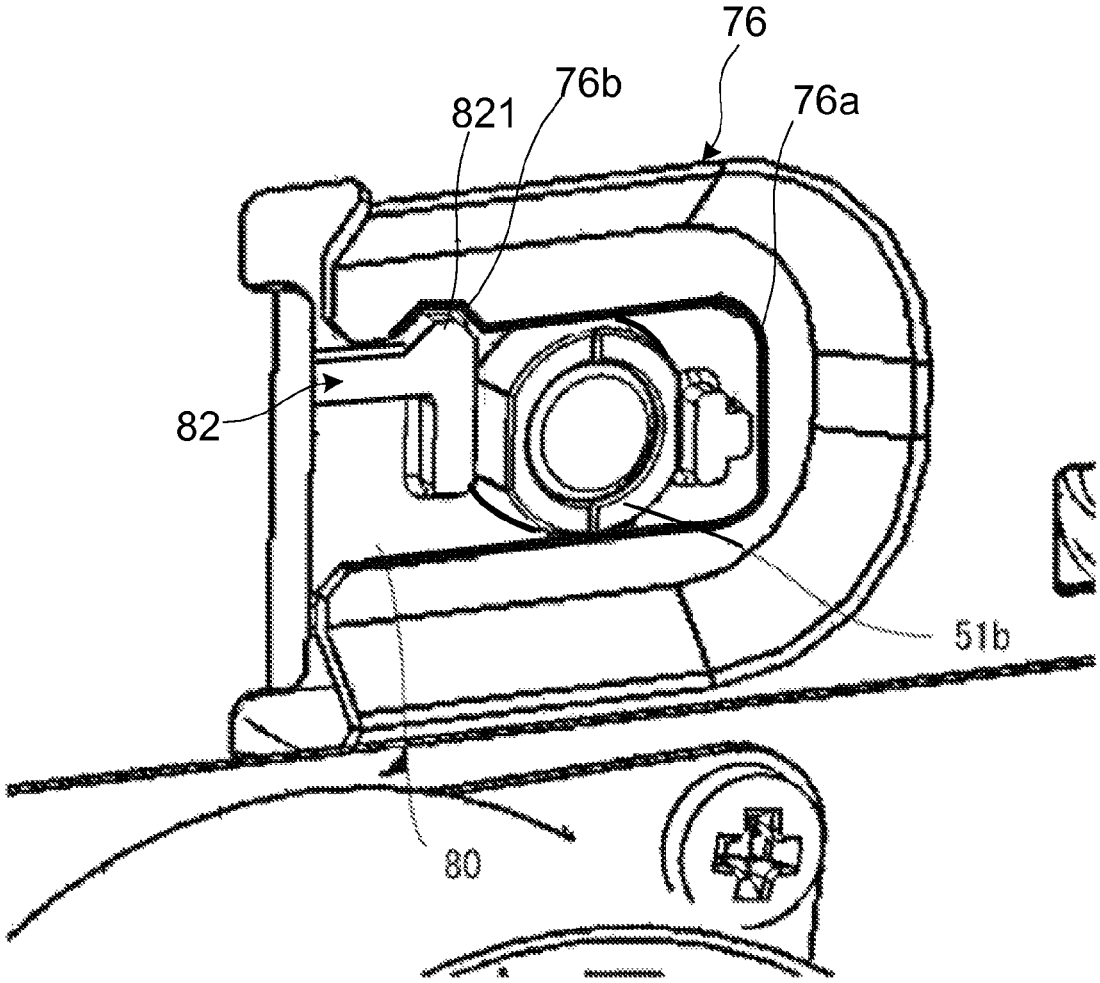
FIG. 16 is a view showing the gear cover and the driving input gear receiving part in a state in which the fixing unit has been inserted and completely fixed.

As shown in FIG. 16, in a state in which the convex shape 821 of the cover side engagement part 82 is fitted with the concave part 76*b*, the fixation of the fixing unit 30 at the fixing unit storage part 75 completes, but for example, as shown in FIG. 13, the convex shape 821 of the cover side engagement part 82 is so formed as to be projected to a position at the same level as an upper end part of the long hole 81 of the gear cover 80. Thus, at a point in time at which the bearing 51*b* starts to be inserted into the receiving part 76*a*, the bearing 51*b* is at a lowest part in the long hole 81, but when the bearing 51*b* is moved in the insertion direction X and the convex shape 821 reaches an inlet of the receiving part 76*a*, the convex shape 821 is caught at the inlet of the receiving part 76*a*. Thus, the operator lifts up the bearing

51*b* with respect to the gear cover 80, moves the bearing 51*b* in the long hole 81 to a highest position, and inserts the convex shape 821 into the receiving part 76*a* as shown in FIG. 15. Then in the insertion direction X, when the convex shape 821 has moved to the position of the concave part 76*b*, the operator moves the gear cover 80 in the Y direction in a manner such that the convex shape 821 fits into the receiving part 76*a* (FIG. 16).

In a typical fixing device, a roller is driven at time of normal rotation of a driving source while applied pressure force adjustment means is driven at time of reverse rotation of the driving source, but when a rotation direction is switched at the time of normal rotation or reverse rotation of the driving source, there arises a problem that escape of a fixing unit is likely to occur. On the contrary, with the image forming apparatus 1 with the configuration described above, in the fixing unit 30 capable of selectively executing driving of the fixing roller 31 or operation of varying the fixing nip pressure, the dislocation of the fixing unit 30 attached to the main body of the image forming apparatus 1 from its attachment position which dislocation is likely to occur at the time of switching of the rotation direction of the driving input gear 51 can be suppressed.

Moreover, since the cover side engagement part 82 and its convex shape 821 are provided at the gear cover 80 movable with respect to the bearing 51*b* of the driving input gear 51, at the time of insertion of the fixing unit 30 into the fixing unit storage part 75, the convex shape 821 of the gear cover 80 can easily be fitted with the concave part 76*b* of the driving input gear receiving part 76.

Moreover, the fixing unit 30 includes the pressure adjustment mechanism 40, which permits the mechanism of driving the two fixing rollers 31 and the mechanism of varying the fixing nip pressure to be individually controlled with a driving force from the single driving motor M, thus permitting cost reduction with smaller costs of components in comparison with a case where the mechanisms are respectively controlled with different driving motors.

In the embodiment described above, a hole for supporting the bearing 51*b* in the gear cover 80 is the long hole 81, but a shape of this hole is not limited to the shape of the long hole 81, and thus it is possible to adopt another shape capable of supporting the bearing 51*b*.

Moreover, in the embodiment, the gear cover 80 has the convex part 82 and the driving input gear receiving part 76 has the concave part 76*b*, but for example, the gear cover may have a concave part and the driving input gear receiving part may have a convex part. Moreover, in the embodiment, the driving input gear receiving part 76 has the concave part 76*b* on a top side of the receiving part 76*a*, but for example, may have it on a bottom side of the receiving part. In this case, providing bias means (for example, spring) biasing the convex part downward can prevent disengagement.

INDUSTRIAL APPLICABILITY

This disclosure is applicable to an image forming apparatus. With this disclosure, the dislocation of the fixing unit 30 attached to the man body of the image forming apparatus 1 from its attachment position can be suppressed, and its industrial applicability is extremely high.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising a fixing unit and a storage part into which the fixing unit is inserted, wherein the fixing unit comprises:

two rollers forming a fixing nip part;

a pressure adjustment mechanism varying fixing nip pressure between the two rollers;

a driving input gear to which a rotational power in a first direction driving the two rollers and a rotational power in a second direction rotating in the direction opposite to the first direction and actuating the pressure adjustment mechanism are transmitted from a driving source outside of the fixing unit; and a gear cover being formed with a hole supporting a bearing supporting a rotary shaft of the driving input gear and supporting the bearing in a state in which the bearing penetrates through the hole and is projected in a direction in which the rotary shaft extends, the gear cover has a cover side engagement part extending in a direction perpendicular to an insertion direction of the fixing unit, formed at the storage part is a receiving part supporting a portion of the bearing of the driving input gear projected from the gear cover, being formed in a manner so as to extend in the insertion direction of the fixing unit and so that a length of the receiving part in a direction orthogonal to the insertion direction is substantially equal to a length of the bearing in the direction orthogonal to the insertion direction, and receiving the bearing while guiding movement of the bearing in the insertion direction when the fixing unit is inserted into the storage part, and the receiving part is provided with a storage side engagement part engaging with the cover side engagement part to regulate the movement of the bearing in the insertion direction when the receiving part is guiding the movement.

2. The image forming apparatus according to claim 1, wherein the receiving part guides the movement of the bearing in the insertion direction while regulating movement of the bearing in the perpendicular direction.

3. The image forming apparatus according to claim 1, wherein the hole formed at the gear cover is a long hole supporting the bearing in a state in which the bearing is movable in the perpendicular direction, and the cover side engagement part is a convex part, and the storage side engagement part is a concave part.

4. The image forming apparatus according to claim 1, wherein the cover side engagement part is a concave part, and the storage side engagement part is a convex part.

5. The image forming apparatus according to claim 1, wherein the fixing unit further comprises a transmission mechanism of: transmitting the rotational power in the first direction to the two rollers without actuating the pressure adjustment mechanism when the rotational power in the first direction is given to the driving input gear; and not transmitting the rotational power in the second direction to the two rollers while actuating the pressure adjustment mechanism when the rotational power in the second direction opposite to the first direction is given to the gear.

6. The image forming apparatus according to claim 1, wherein the cover side engagement part is arranged adjacently to the hole.

7. The image forming apparatus according to claim 1, wherein the fixing unit includes a fixing screw and a screw hole, and the storage part has a fixing part capable of screwing the fixing screw via the screw hole in a state in which the fixing unit is stored in the storage part and the storage side engagement part engages with the cover side engagement part.

* * * * *